US010179421B2

(12) United States Patent
Doty

(10) Patent No.: US 10,179,421 B2
(45) Date of Patent: Jan. 15, 2019

(54) RIGID PUNCH TOOL

(71) Applicant: Omnitool, Inc., Minneapolis, MN (US)

(72) Inventor: Eric Doty, Champlin, MN (US)

(73) Assignee: Omnitool, Inc., Minneapolis, MN (US)

( * ) Notice: Subject to any disclaimer, the term of this patent is extended or adjusted under 35 U.S.C. 154(b) by 0 days.

(21) Appl. No.: 15/847,629

(22) Filed: Dec. 19, 2017

(65) Prior Publication Data

US 2018/0104840 A1 Apr. 19, 2018

Related U.S. Application Data

(63) Continuation of application No. 15/156,266, filed on May 16, 2016, now Pat. No. 9,878,461.

(60) Provisional application No. 62/161,680, filed on May 14, 2015.

(51) Int. Cl.

| | |
|---|---|
| ***B26D 7/26*** | (2006.01) |
| ***B26F 1/14*** | (2006.01) |
| ***B26F 1/18*** | (2006.01) |
| *B26F 1/02* | (2006.01) |

(52) U.S. Cl.

CPC ..... *B26D 7/2614* (2013.01); *B26F 1/14* (2013.01); *B26F 1/18* (2013.01); *B26F 1/02* (2013.01)

(58) Field of Classification Search

CPC . B26D 7/2614; B26F 1/18; B26F 1/14; B26F 1/02

See application file for complete search history.

(56) References Cited

U.S. PATENT DOCUMENTS 3,996,832 A * 12/1976 Schubert ..... B26F 1/14 83/686
4,165,669 A * 8/1979 Brown ..... B21D 28/12 83/552
4,375,774 A * 3/1983 Wilson ..... B21D 28/34 83/140
4,945,752 A * 8/1990 Stursberg ..... B21D 37/14 72/404
5,140,879 A * 8/1992 Haj-Ali-Ahmadi ..... B26F 1/04 234/1
5,301,580 A * 4/1994 Rosene ..... B21D 45/006 83/136
5,329,835 A * 7/1994 Timp ..... B21D 28/34 83/686
5,682,782 A * 11/1997 Rosene ..... B21D 11/08 72/179

(Continued)

OTHER PUBLICATIONS

"Spares ISO-View 1A," Freeman, www.freemancompany.com, Jan. 17, 2013, 1 pp.

(Continued)

*Primary Examiner* — Sean M Michalski

(74) *Attorney, Agent, or Firm* — Grumbles Law PLLC; Paul Feng; Brittany Nanzig

(57) ABSTRACT

A rigid punch tool for cutting vents into plastic thermoformed containers. More specifically, a rigid punch tool comprising a holder with a plurality of slots; and a plurality of punches, each punch comprising a blade, a base, and attachment points, wherein, for each punch, the base of the punch fits into one of the plurality of slots in the holder, the base of the punch is wider than the blade of the punch, and bolts or pins fit in the attachment points to secure each punch to the holder.

20 Claims, 7 Drawing Sheets

(56) References Cited

U.S. PATENT DOCUMENTS 5,816,130 A * 10/1998 Aukerman ..... B26D 7/2614 83/698.31
5,957,826 A * 9/1999 Bohn ..... B26D 7/2614 493/354
6,267,036 B1 * 7/2001 Lani ..... A23N 15/00 30/315
6,298,761 B1 * 10/2001 Houser ..... B26D 5/08 83/571
9,579,920 B2 * 2/2017 Schneider ..... B21D 28/34
9,878,461 B2 1/2018 Doty
2002/0117026 A1 * 8/2002 Chang ..... B26F 1/44 76/107.8
2003/0084997 A1 * 5/2003 Wu ..... B24B 37/34 156/345.12
2003/0226437 A1 * 12/2003 Rosene ..... B21D 45/006 83/684
2005/0050740 A1 * 3/2005 Lin ..... B25B 7/04 30/363
2005/0081695 A1 * 4/2005 Lee ..... B26F 1/14 83/687
2005/0132856 A1 * 6/2005 Geffros ..... B26D 7/18 83/164
2005/0257594 A1 * 11/2005 Hutchison ..... B23P 15/406 72/482.93
2007/0031211 A1 * 2/2007 Schmidkonz ..... B26F 1/14 412/6
2007/0062357 A1 * 3/2007 Pedrys ..... B26D 3/10 83/605
2007/0172535 A1 * 7/2007 Fridley ..... B26D 7/2614 425/313
2011/0023680 A1 * 2/2011 Wang ..... B26D 1/09 83/698.21
2011/0278060 A1 * 11/2011 Rajvanshi ..... H02G 3/085 174/666
2012/0017743 A1 * 1/2012 Pierret ..... B26D 7/2614 83/699.51
2014/0116218 A1 * 5/2014 Kwarta ..... B26D 1/245 83/425.4
2014/0121085 A1 * 5/2014 Kwarta ..... B26D 7/2628 483/10
2014/0338510 A1 * 11/2014 Lee ..... B26D 5/086 83/167
2015/0000485 A1 * 1/2015 Piro ..... B26F 1/02 83/30
2016/0193746 A1 * 7/2016 Hu ..... B26D 7/0006 83/563
2016/0288353 A1 * 10/2016 McCracken ..... B26D 1/29
2018/0333886 A1 * 11/2018 Gereg ..... B26D 7/2614

OTHER PUBLICATIONS

"Image 1," Freeman, www.freemancompany.com, 2002, 1 pp.
"Image 2," Freeman, www.freemancompany.com, 2002, 1 pp.

* cited by examiner

RIGID PUNCH TOOL

CROSS-REFERENCE TO RELATED APPLICATIONS

This application is a continuation of U.S. patent application Ser. No. 15/156,266, filed May 16, 2016 and titled RIGID PUNCH TOOL, which claims the benefit of U.S. Provisional Patent Application No. 62/161,680, filed May 14, 2015 and titled RIGID PUNCH TOOL.

BACKGROUND OF THE INVENTION

Packaging and transport of food are important components to maintaining freshness and reducing damage to food before and after food gets to the consumer. For example, vegetables, eggs, and baked goods often need to be protected within their packaging to compensate for any rough transport. If the food is damaged, it is no longer appealing and, sometimes, no longer useable.

Another example of a common grocery staple is fruit, wherein the variety, quality and quantity of fruit vary by season, location of retail sale, and perishability of a given fruit. Food retailers typically seek to offer a wide choice of fruit products to their customers notwithstanding difficulty and cost. All types of food pose unique availability and transport challenges. For example, many berries are only available at certain times of year and only in certain locations. Further, as a group, berries easily bruise and spoil and/or develop mold from exposure to excess moisture.

To address the above issues, growers and wholesalers use specialized plastic containers, such as plastic clamshells or tills that are assembled by cutting holes in thermoformed parts. These plastic containers provide physical protection for the contents and have vents in them to allow for drainage and airflow.

To make the plastic containers, manufacturers use a punch and die assembly, wherein the punch and die assemblies are guided to each other using a set of pins. The current standard punch assembly is comprised of a punch holder, several punches, and a plate on the outside of the assembly that mounts against the holder and holds the punches in place. The die assembly is comprised of a die with a plurality of holes that the punches mate to. Several die assemblies then mount to a larger plate to enable several thermoformed parts to be cut simultaneously.

Standard punches have a number of issues that lead to problems and cost issues in the manufacturing process and in the resulting containers, such as: poor stability; thin blades; uniform thickness; attachment too far from the blade; and excessive flexing. These drawbacks result in punches that break easily. Additionally, it is difficult to replace the punches because the entire punch assembly must be taken apart to replace one punch. Another drawback is that the machines that the standard punch and die assemblies attach to easily damage the assemblies and thereby increase maintenance requirements for the assemblies. When the punch assemblies are damaged, they do not cleanly cut the vents and therefore, the plastic containers have rough-cut vents (i.e., chads) that, for example, cut the fruit or affect the roots of the plant. Sometimes, the parts of the plastic container that are supposed to be cut out remain in the container with the food creating a safety issue. Un-removed chads can also adversely affect how the product moves through the automation systems. Further, they present potential issues if consumers ingest them.

A new punch assembly is needed with punches that are more resistant to damage. Further, a punch assembly is needed that has punches that, if damaged, can be more easily replaced.

SUMMARY OF THE INVENTION

The disclosed device is a rigid punch tool, which, when assembled into a punch and die assembly, can be used to cut vents into plastic thermoformed containers. More specifically, in one embodiment, the rigid punch tool is comprised of a holder with several slots and a plurality of punches. Each punch is comprised of a blade, a base, and attachment points, such as a clearance hole and a tapped hole. Each punch's base fits into one of the several slots in the holder and each punch's base is wider than its blade. Each of a plurality of clearance bolts fits into a clearance hole and helps secure a punch to the holder. Each of a plurality of tapped bolts fits into a tapped hole and helps secure a punch to the holder.

In another embodiment, the rigid punch tool is comprised of a holder with several slots; a plurality of punches, each punch comprising a blade, a base, and a plurality of mounting holes, wherein the base of the punch fits into one of the several slots in the holder and is wider than the blade; and a plurality of mounting bolts, each mounting bolt fitting into a mounting hole and mounting a punch to the holder.

In yet another embodiment, the rigid punch tool is comprised of a holder with several slots; a plurality of punches, each punch comprising a blade, a base, and a plurality of dowel pin holes, wherein the base of the punch fits into one of the several slots in the holder and is wider than the blade; a plate attached to the holder by a plurality of screws, wherein the plate holds the punches in place; and a plurality of dowel pins attached to the plate, wherein the placement of the dowel pins on the plate causes the dowel pins to line up to the dowel pin holes when the plate is attached to the holder.

DETAILED DESCRIPTION

Figure 1:
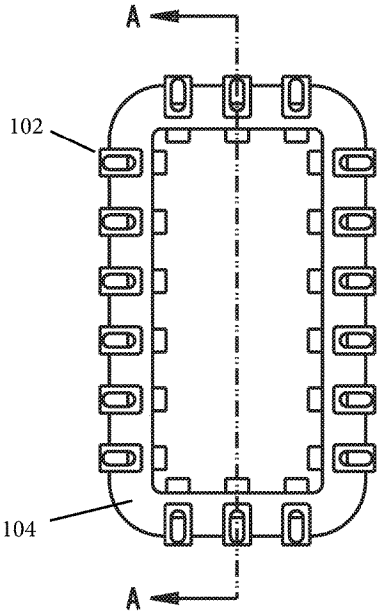
FIG. 1 is a top view of one embodiment of the disclosed rigid punch tool.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. It is understood that various omissions and substitutions of equivalents are contemplated as circumstances may suggest or render expedient, but these are intended to cover application or embodiments without departing from the spirit or scope of the claims attached hereto. Also, it is to be understood that the phraseology and terminology used herein are for the purpose of description and should not be regarded as limiting.

Figure 4:
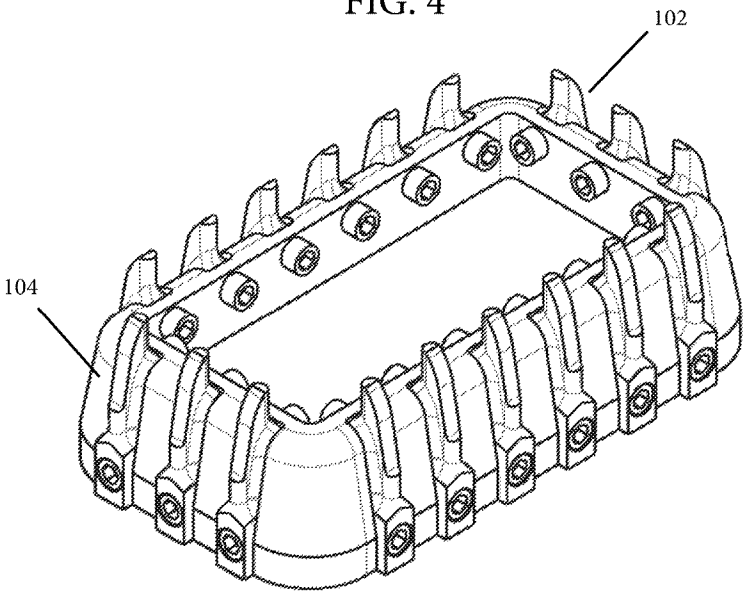
FIG. 4 is a top right orthographic view of the disclosed rigid punch tool of FIG. 1.

The disclosed device is a rigid punch tool used to cut holes or vents into thermoformed parts to create specialized plastic containers. More specifically, in one embodiment, the rigid punch tool is comprised of a holder 104 with several slots 902, wherein each slot 902 is comprised of attachment points such as, but not limited to, a clearance hole 1002 and a tapped hole 1004 that can be vertically or horizontally in line with each other or offset from each other; a plurality of punches 102, each punch 102 comprising a blade 702, a base 502, and two holes to line up with the clearance hole 1002 and the tapped hole 1004, wherein the punch's base 502 fits into one of the several slots 902 in the holder 104, wherein the punch's base 502 is wider than its blade 702, and wherein the blade 702 extends above the holder 104; a plurality of clearance bolts 202, each clearance bolt 202 fitting into a clearance hole 1002 through the inside of the holder 104 and the back of a punch 102 and mounting the punch 102 to the holder 104, as illustrated in FIG. 4; and a plurality of tapped bolts 204, each tapped bolt 204 fitting into a tapped hole 1004 through the front of a punch 102 and the outside of the holder 104 and mounting the punch 102 to the holder 104, as illustrated in FIG. 4.

Figure 16:
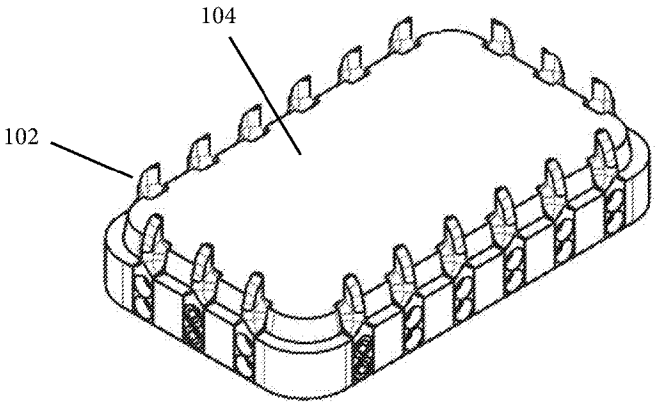
FIG. 16 is a top right orthographic view of the disclosed rigid punch tool of FIG. 13.
Figure 13:
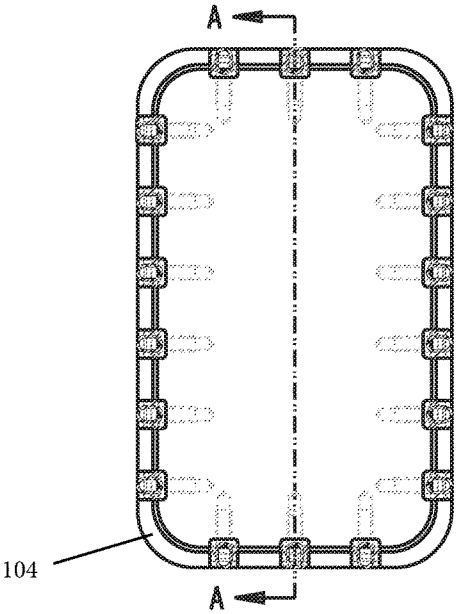
FIG. 13 is a top view of a second embodiment of the disclosed rigid punch tool.

In another embodiment, illustrated in FIG. 16, the rigid punch tool is comprised of a holder 104 with several slots 902, wherein each slot 902 is comprised of attachment points, such as, but not limited to, a plurality of tapped holes 1004 that can be vertically or horizontally in line with each other or offset from each other; a plurality of punches 102, each punch 102 comprising a blade 702, a base 502, and a plurality of holes to line up with the tapped holes 1004, wherein the base 502 fits into one of the several slots 902 in the holder 104 and is wider than the blade 702; and a plurality of tapped bolts 204, each tapped bolt 204 fitting into a tapped hole 1004 through the front of a punch 102 and the outside of the holder 104 and mounting the punch 102 to the holder 104.

In some embodiments, the holder 104 is a rectangular block with a plurality of slots 902 or openings on its outside surface, as illustrated in FIGS. 9-12 and 21-24. Each slot 902 can run the height of the holder 104 and can have a clearance hole 1002 and a tapped hole 1004. Further, the base 502 can have the same height as the slot 902. The clearance hole 1002 can be located above the tapped hole 1004 nearest to where the blade 702 for a punch 102 will connect to the base 502 when the punch 102 is mounted to the holder 104. The tapped hole 1004 can be near the base of the holder 104. The slots 902 and the punches 102 are designed to fit snuggle to solidify the rigidity of the overall device.

Figure 22:
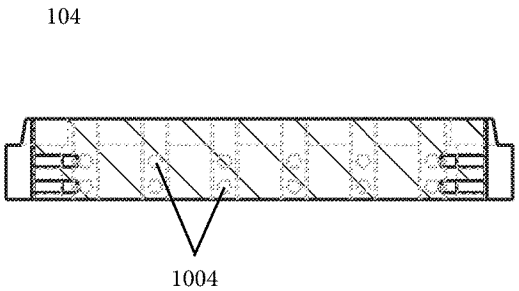
FIG. 22 is a right side cross-sectional view of the disclosed holder of FIG. 13 taken from line A in FIG. 13; the left side cross-sectional view is a mirror image of the right side cross-sectional view.
Figure 23:
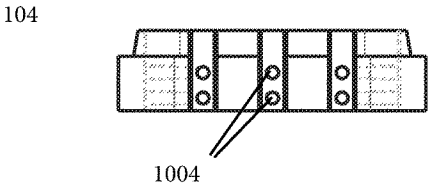
FIG. 23 is a front view of the disclosed holder of FIG. 13; the back view is a mirror image of the front view.
Figure 24:
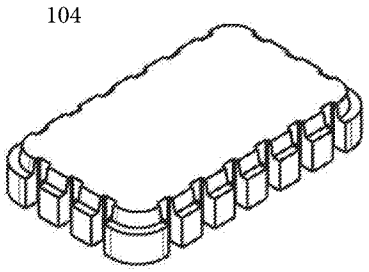
FIG. 24 is a top right orthographic view of the holder of FIG. 13.
Figure 26:
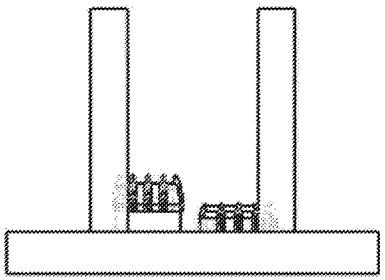
FIG. 26 is a front view of a die assembly that holds more than one rigid punch tool; the back view is a mirror image of the front view.
Figure 28:
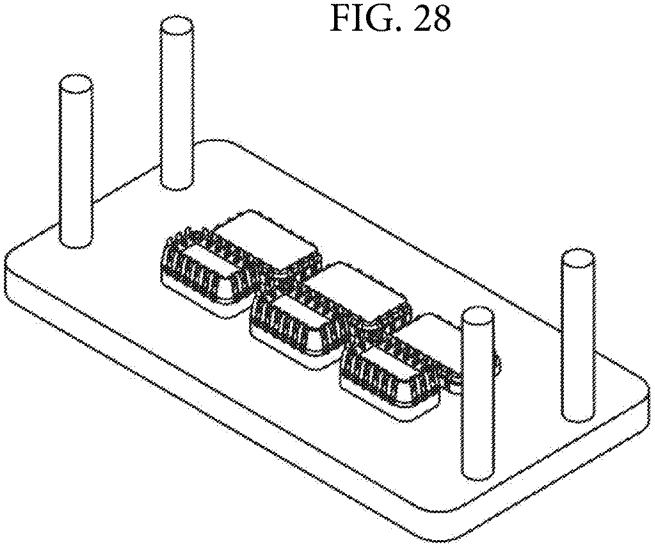
FIG. 28 is a top left perspective view of a die assembly that holds more than one rigid punch tool.
Figure 25:
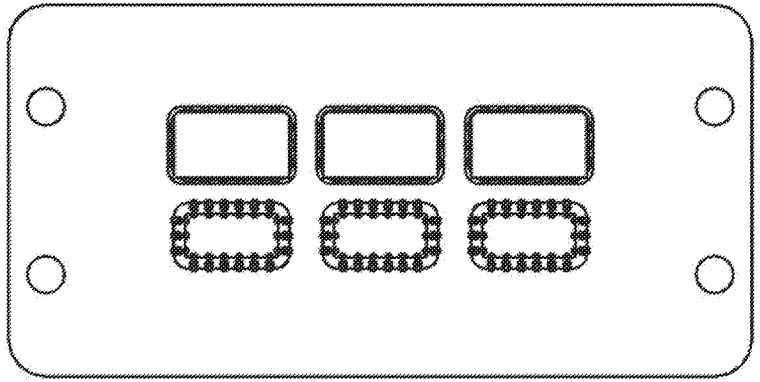
FIG. 25 is a top view of a die assembly that holds more than one rigid punch tool.
Figure 27:
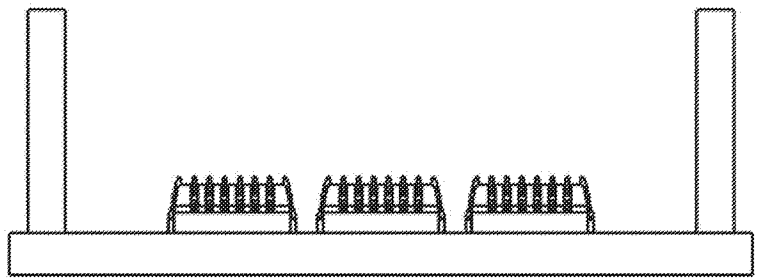
FIG. 27 is a right side view of a die assembly that holds more than one rigid punch tool; the left side view is a mirror image of the right side view.

In another embodiment, each slot 902 in the holder 104 can have two tapped holes 1004 located where the punch base 502 will mount to the holder 104. Preferably, the two tapped holes 1004 will align so that one tapped hole 1004 is located directly above the other tapped hole 1004, resulting in an upper tapped hole and a lower tapped hole, as illustrated in FIGS. 22 and 23.

The dimensions of the holder 104 can vary based on the type of punch 102 that is used. For example, in one embodiment, the holder 104 can be approximately 6.1 to 6.5 inches long, 3.5 to 3.8 inches wide, and 1.5 to 2.0 inches tall, as illustrated in FIGS. 1, 3, 9, and 11. In another embodiment, the holder 104 can be approximately, 6.8 to 6.9 inches long, 4.1 to 4.2 inches wide, and 1.0 to 1.5 inches tall, as illustrated in FIGS. 13, 15, 21 and 23. In some embodiments, the holder 104 is rectangular and can have three slots 902 on each of its short ends and six slots 902 on each of its long ends.

In some embodiments, the punch 102, which is the component of the rigid punch tool that cuts the vents and openings into plastic containers, is an elongated object with a generally rectangular base 502 and a blade 702 protruding from the front and the top of the base 502, as illustrated in FIGS. 5-8 and 17-20. In a preferred embodiment, each punch 102 has a thick base 502 that can be held securely against the holder 104 and at least two holes, although a possible configuration includes one hole. In some embodiments, the bottom of the punch can be the thickest part of the base 502, the middle of the punch can include a combination of the base 502 and the blade 702, and the top of the punch can include just the blade 702. This configuration offers considerable stability for the blade 702. In some embodiments, when the base 502 is attached to a slot 902 in the holder 104, the blade 702 may protrude from the top of the holder 104.

Figure 7:
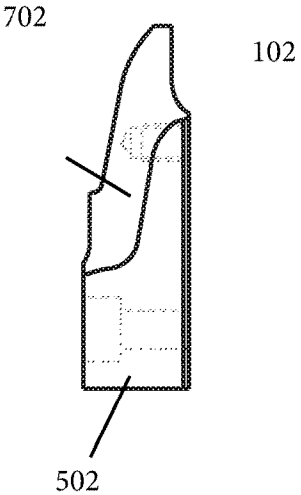
FIG. 7 is a right side view of the disclosed punch of FIG. 1; the left side view is a mirror image of the right side view.
Figure 5:
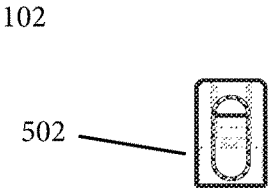
FIG. 5 is a top view of the disclosed punch of FIG. 1.
Figure 6:
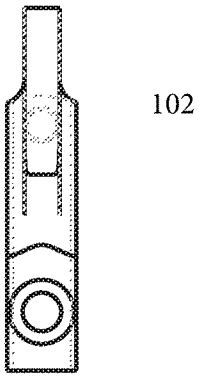
FIG. 6 is a front view of the disclosed punch of FIG. 1.
Figure 9:
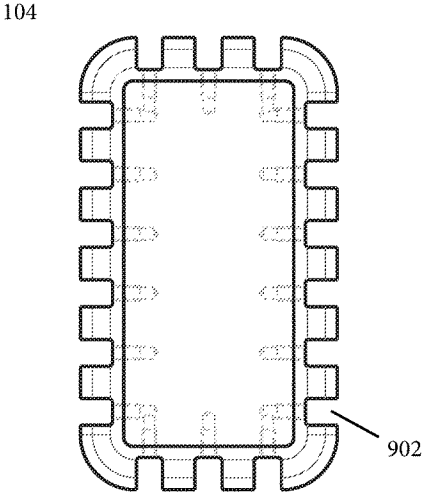
FIG. 9 is a top view of the disclosed holder of FIG. 1.
Figure 10:
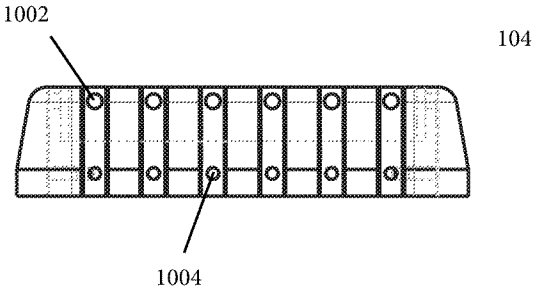
FIG. 10 is a right side view of the disclosed holder of FIG. 1; the left side view is a mirror image of the right side view.
Figure 11:
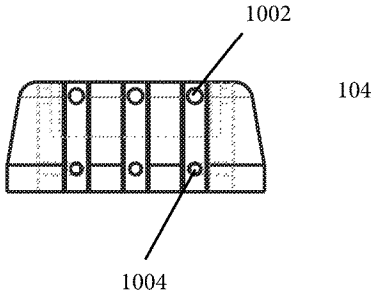
FIG. 11 is a front view of the disclosed holder of FIG. 1; the back view is a mirror image of the front view.
Figure 17:
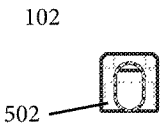
FIG. 17 is a top view of the disclosed punch of FIG. 13.
Figure 18:
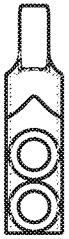
FIG. 18 is a front view of the disclosed punch of FIG. 13.
Figure 19:
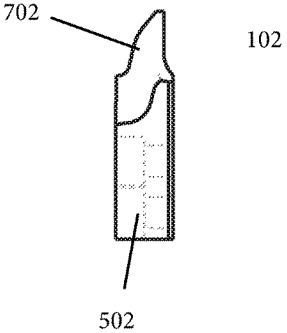
FIG. 19 is a right side view of the disclosed punch of FIG. 13; the left side view is a mirror image of the right side.

The dimensions of the punch 102 can vary based on the location of the holes used to secure the punch 102 to the holder 104. For example, in one embodiment, each punch 102 can be approximately 1.8 to 2.0 inches tall, 0.20 to 0.40 inches wide, and 0.50 to 0.60 inches deep, as illustrated in FIGS. 5-7. The blade 702 can be 0.10 to 0.20 inches wide. In another embodiment, each punch 102 can be approximately 1.3 to 1.5 inches tall, 0.20 to 0.40 inches wide, and 0.30 to 0.40 inches deep, as illustrated in FIGS. 17-18. The blade 702 can be 0.10 to 0.20 inches wide.

Figure 2:
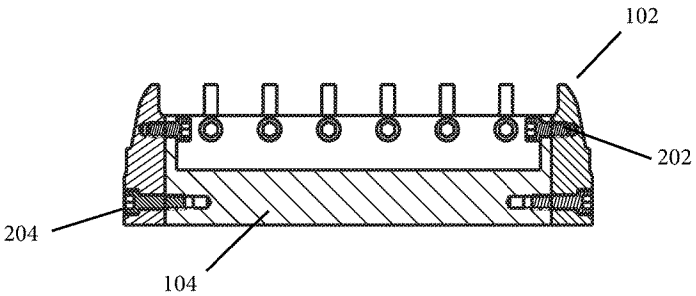
FIG. 2 is a right side cross-sectional view of the disclosed rigid punch tool of FIG. 1 taken from the line A in FIG. 1; the left side cross-sectional view is a mirror image of the right side cross-sectional view.
Figure 3:
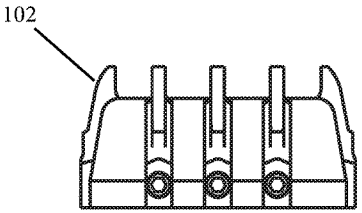
FIG. 3 is a front view of the disclosed rigid punch tool of FIG. 1; the back view is a mirror image of the front view.
Figure 8:
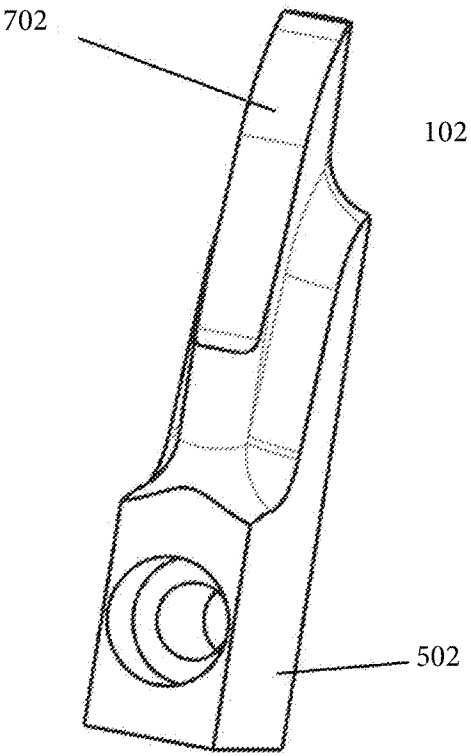
FIG. 8 is a right side orthographic view of the disclosed punch of FIG. 1.
Figure 12:
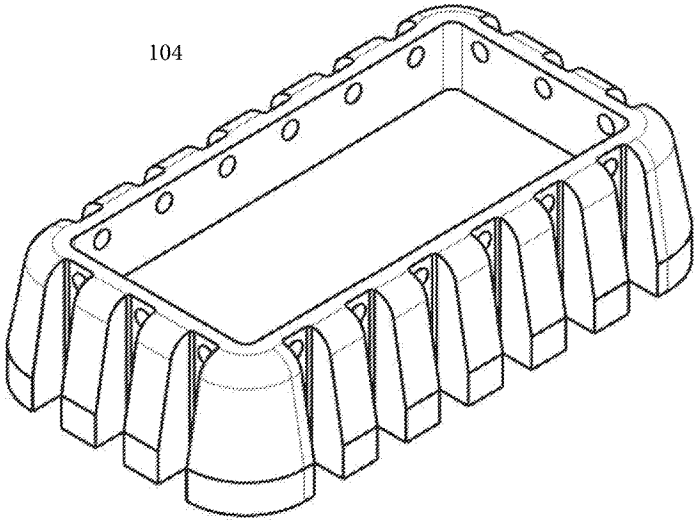
FIG. 12 is a right side orthographic view of the disclosed holder of FIG. 1.

In an embodiment where the punch 102 has two holes, a first hole can be located near the top part of the middle of the punch, as illustrated in FIG. 7, and a second hole can be located at the bottom of the punch, as illustrated in FIGS. 6-8. In some embodiments, the first hole is located on the back of the punch, does not penetrate completely through the punch 102, as illustrated in FIG. 7, and is designed to line up with a clearance hole 1002 on the holder 104, as illustrated in FIGS. 2 and 4. Therefore, the holder 104 for this type of punch 102 has a hollow portion in the middle, as illustrated in FIGS. 4 and 12, so a user can insert the bolt from the back of the punch. In some embodiments, the second hole can penetrate completely through the punch 102 and is designed to line up with a tapped hole 1004 on the holder 104, as illustrated in FIGS. 2 and 4. The tapped bolt 204 can be inserted into the tapped hole 1004 from the front of the punch.

Figure 14:
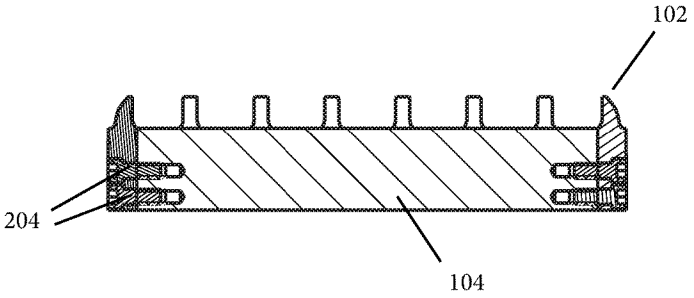
FIG. 14 is a right side cross-sectional view of the disclosed rigid punch tool of FIG. 13 taken from line A in FIG. 13; the left side cross-sectional view is a mirror image of the right side cross-sectional view.
Figure 15:
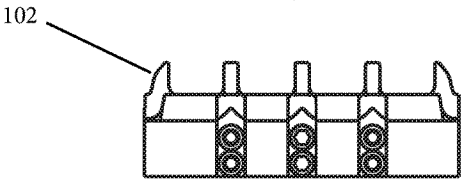
FIG. 15 is a front view of the disclosed rigid punch tool of FIG. 13; the back view is a mirror image of the front view.
Figure 20:
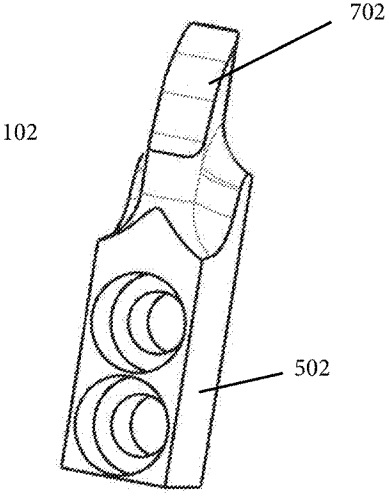
FIG. 20 is a right side orthographic view of the disclosed punch of FIG. 13.
Figure 21:
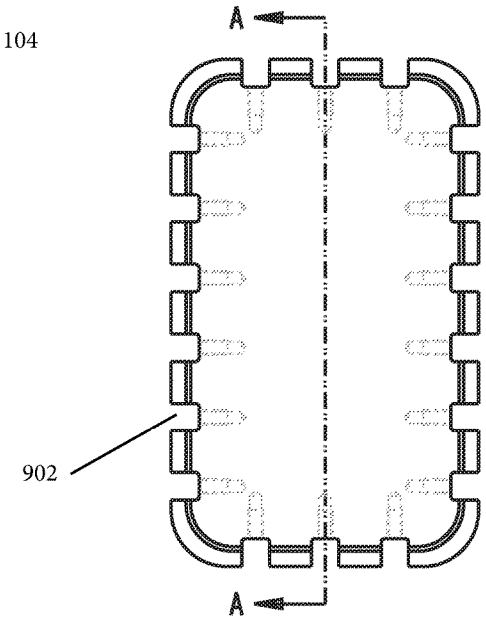
FIG. 21 is a top view of the disclosed holder of FIG. 13.

In other embodiments, the first and the second holes can completely penetrate the punch base 502, as illustrated in FIG. 20, and can be designed to line up with the two mounting holes on the holder 104, as illustrated in FIGS. 14-16. In this embodiment, the holder 104 does not have a hollow middle portion, but it is instead solid, because both holes in the punch 102 are accessible from the front of the punch. In this embodiment, a bigger proportion of the punch 102 can be allotted to a thick base 502. For example, as illustrated in FIG. 20, half of the punch 102, instead of roughly one third, can include the thickest part of the base 502, and a smaller portion of the punch 102 can include both the base 502 and the blade 702. The length of the blade 702 can vary, but will likely have a similar length to the embodiment illustrated in FIGS. 1-8.

Other embodiments are possible, wherein one or both holes can be located on one or both sides or where one hole, both holes, or neither hole penetrates completely through the punch 102.

The design of the disclosed punch 102 enables the punch 102 to be bolted near the blade 702 and at the punch base 502. This attachment mechanism better secures each punch 102 to the holder 104 and enables the punch 102 to be considerably more stable and rigid than previous versions of punches. For example, the blade 702 is much less likely to move when it is pushed on its side, thus resulting in fewer blade breakages.

Additionally, by attaching each punch 102 to the holder 104 using individual bolts, instead of a mounting plate, a user can more easily replace individual punches 102 if and when they break or are otherwise damaged. Therefore, the disclosed rigid punch tool easily accommodates a damaged punch 102 by enabling a user to replace the damaged punch 102 with a new, identical punch 102 and not wasting the remaining components of the rigid punch tool.

Additionally, a user can easily replace or reuse a worn or abused holder 104. For example, the holder 104, which is designed to fit onto a larger die assembly, as illustrated in FIGS. 25-28, can be removed and replaced using an identical spare, similar to the process of replacing a punch 102. In an example of reusing the holder 104, if the holder 104 has enlarged slots 902, a user can enlarge the punch base 502 to be a perfect fit. Because the blade 702 is still the same size, the rigid punch tool is still usable for cutting holes or vents into thermoformed parts.

In an alternative embodiment, the rigid punch tool is comprised of a holder with several slots; a plurality of punches, each punch comprising a blade, a base, and a plurality of dowel pin holes, wherein the base of the punch fits into one of the several slots in the holder and is wider than the blade; a plate attached to the holder by a plurality of screws, wherein the plate holds the punches in place; and a plurality of dowel pins attached to the plate, wherein the placement of the dowel pins on the plate cause the dowel pins to line up to the dowel pin holes when the plate is attached to the holder.

The disclosed rigid punch tool can be made of plastic or metal. For example, in a preferred embodiment, the punch 102 and the holder 104 are made of steel for maximum strength. Various types of steel that can be used include, but are not limited to, carbide, H13 tool steel, D2 tool steel, A2 tool steel, etc.

As described above, the disclosed rigid punch tool is designed to fit onto a larger die assembly, as illustrated in FIGS. 25-28. In one embodiment, the die assembly can hold six rigid punch tools at one time.

The invention claimed is:

1. A rigid punch tool, comprising:

a holder with a plurality of slots, each slot having one or more slot holes; and a plurality of punches, each punch having a blade, a base, and one or more punch holes corresponding to each of the one or more slot holes of at least one of the plurality of slots, wherein each one of the plurality of punches is paired with a corresponding one of the plurality of slots; and wherein for each pair of one of the plurality of punches and corresponding one of the plurality of slots:

the base of the punch is shaped and configured to fit into the slot;

when the base of the punch is fit into the slot, a first slot hole of the one or more slot holes aligns with a first punch hole of the one or more punch holes;

one of the first slot hole and the first punch hole is a tapped hole, and the other of the first slot hole and the first punch hole is a clearance hole; and when the base of the punch is fit into the slot, a first screw can fit through the clearance hole and screw into the tapped hole to secure the punch to the holder.

2. The tool of claim 1, wherein for each pair of one of the plurality of punches and corresponding one of the plurality of slots, the first slot hole is the tapped hole.

3. The tool of claim 1, wherein for each pair of one of the plurality of punches and corresponding one of the plurality of slots, the first punch hole is the tapped hole.

4. The tool of claim 1, wherein for each pair of one of the plurality of punches and corresponding one of the plurality of slots:

when the base of the punch is fit into the slot, a second slot hole of the one or more slot holes aligns with a second punch hole of the one or more punch holes;

one of the second slot hole and the second punch hole is a second tapped hole, and the other of the second slot hole and the second punch hole is a second clearance hole; and when the base of the punch is fit into the slot, a second screw can fit through the second clearance hole and screw into the second tapped hole to secure the punch to the holder.

5. The tool of claim 4, wherein for each pair of one of the plurality of punches and corresponding one of the plurality of slots, the first slot hole is the tapped hole and the second slot hole is the second tapped hole.

6. The tool of claim 4, wherein for each pair of one of the plurality of punches and corresponding one of the plurality of slots, the first punch hole is the tapped hole and the second punch hole is the second tapped hole.

7. The tool of claim 4, wherein for each pair of one of the plurality of punches and corresponding one of the plurality of slots, the first punch hole is the tapped hole and the second slot hole is the second tapped hole.

8. The tool of claim 7, wherein when the rigid punch tool is positioned for use in conjunction with a die, for each pair of one of the plurality of punches and corresponding one of the plurality of slots, the first punch hole and the first slot hole are disposed closer to the die than the second punch hole and the second slot hole.

9. The tool of claim 1, wherein each punch has exactly one punch hole.

10. A punch configured to attach to a punch holder, comprising:

a base; and a blade attached to the base, wherein:

the punch is configured to attach to a punch holder at one of a plurality of slots of the punch holder, each slot defining one or more slot holes;

the base of the punch is shaped and configured to fit into the one of the plurality of slots;

the punch defines one or more punch holes, each of the one or more punch holes corresponding to one of the one or more slot holes of the one of the plurality of slots;

when the base of the punch is fit into the one of the plurality of slots, a first punch hole of the one or more punch holes aligns with a first slot hole of the one or more slot holes;

one of the first punch hole and the first slot hole is a tapped hole, and the other of the first punch hole and the first slot hole is a clearance hole;

when the base of the punch is fit into the one of the plurality of slots, a first screw can fit through the clearance hole and screw into the tapped hole to secure the punch to the holder.

11. The punch of claim 10, wherein the first punch hole is the tapped hole.

12. The punch of claim 10, wherein the first punch hole is the clearance hole.

13. The punch of claim 10, wherein:

when the base of the punch is fit into the one of the plurality of slots, a second punch hole of the one or more punch holes aligns with a second slot hole of the one or more slot holes;

one of the second punch hole and the second slot hole is a second tapped hole, and the other of the second punch hole and the second slot hole is a second clearance hole; and when the base of the punch is fit into the one of the plurality of slots, a second screw can fit through the second clearance hole and screw into the second tapped hole to secure the punch to the holder.

14. The punch of claim 13, wherein the first punch hole is the tapped hole and the second punch hole is the second tapped hole.

15. The punch of claim 13, wherein the first punch hole is the clearance hole and the second punch hole is the second clearance hole.

16. The punch of claim 13, wherein the first punch hole is the tapped hole and the second punch hole is the second clearance hole.

17. The punch of claim 10, wherein the punch defines exactly one punch hole.

18. A rigid punch tool, comprising:

a holder with a plurality of slots, each slot having an upper slot hole and a lower slot hole, the lower slot hole being a lower tapped hole; and a plurality of punches, each punch having a blade, a base, an upper punch hole and a lower punch hole, the lower punch hole being a lower clearance hole, wherein each one of the plurality of punches is paired with a corresponding one of the plurality of slots;

wherein for each pair of one of the plurality of punches and corresponding one of the plurality of slots:

the base of the punch is shaped and configured to fit into the slot;

one of the upper slot hole and the upper punch hole is an upper tapped hole, and the other of the upper slot hole and the upper punch hole is an upper clearance hole; and when the base of the punch is fit into the slot:

the upper slot hole aligns with the upper punch hole such that an upper screw can fit through the upper clearance hole and screw into the upper tapped hole to secure the punch to the holder; and the lower slot hole aligns with the lower punch hole such that a lower screw can fit through said lower punch hole and screw into the lower slot hole to secure the punch to the holder; and wherein when the rigid punch tool is positioned for use in conjunction with a die, the upper slot and punch holes are closer to the die than the lower slot and punch holes.

19. The tool of claim 18, wherein for each pair of one of the plurality of punches and corresponding one of the plurality of slots, the upper slot hole is the upper tapped hole and the upper punch hole is the upper clearance hole.

20. The tool of claim 18, wherein for each pair of one of the plurality of punches and corresponding one of the plurality of slots, the upper slot hole is the upper clearance hole and the upper punch hole is the upper tapped hole.

* * * * *